US008087890B2

(12) United States Patent
Gallet

(10) Patent No.: US 8,087,890 B2
(45) Date of Patent: Jan. 3, 2012

(54) TURBOPROP HAVING A PROPELLER MADE UP OF VARIABLE-PITCH BLADES

(75) Inventor: Francois Gallet, Paris (FR)

(73) Assignee: SNECMA, Paris (FR)

( * ) Notice: Subject to any disclaimer, the term of this patent is extended or adjusted under 35 U.S.C. 154(b) by 984 days.

(21) Appl. No.: 12/017,566

(22) Filed: Jan. 22, 2008

(65) Prior Publication Data

US 2008/0247877 A1 Oct. 9, 2008

(30) Foreign Application Priority Data

Jan. 23, 2007 (FR) ..... 07 52823

(51) Int. Cl.
*B64C 11/30* (2006.01)

(52) U.S. Cl. ..... 416/26; 416/131; 416/154

(58) Field of Classification Search ..... 416/26, 416/27, 131, 136, 140, 153, 154, 156, 159; 92/15, 17
See application file for complete search history.

(56) References Cited

U.S. PATENT DOCUMENTS 2,462,932 A * 3/1949 Anderson ..... 416/158
2,653,671 A * 9/1953 Martin et al. ..... 416/154
2,801,068 A 7/1957 Deriaz
2,954,830 A 10/1960 Gehres
3,367,424 A 2/1968 Fukasu et al.
3,501,251 A * 3/1970 Hedberg et al. ..... 416/157 R
3,720,060 A 3/1973 Davies et al.
3,844,681 A 10/1974 Kolesnikov et al.
4,534,704 A * 8/1985 McArdle ..... 416/158

FOREIGN PATENT DOCUMENTS

DE 39 05 282 C1 5/1990
DE 44 46 622 A1 6/1996
FR 2 046 297 3/1971
FR 2 144 831 2/1973

OTHER PUBLICATIONS

U.S. Appl. No. 11/937,168, filed Nov. 8, 2007, Gallet.
U.S. Appl. No. 12/019,155, filed Jan. 24, 2008, Gallet.

* cited by examiner

*Primary Examiner* — Edward Look
*Assistant Examiner* — Andrew C Knopp
(74) *Attorney, Agent, or Firm* — Oblon, Spivak, McClelland, Maier & Neustadt, L.L.P.

(57) ABSTRACT

A turboprop having a set of variable-pitch rotary blades constrained to rotate with a rotary support. In order to vary its pitch, each blade of said set is coupled to a specific hydraulic actuator carried by the rotary support.

13 Claims, 5 Drawing Sheets

TURBOPROP HAVING A PROPELLER MADE UP OF VARIABLE-PITCH BLADES

The invention relates to a turboprop having at least one propeller made up of a set of controlled variable-pitch blades, with the variable pitch of the blades constituting one of the parameters serving to control the thrust of the turboprop. The invention relates more particularly to a novel system for controlling the pitch of such blades.

BACKGROUND OF THE INVENTION

A turboprop with two propellers is known, e.g. from U.S. Pat. No. 4,758,129, which turboprop comprises a turbine with two contrarotating rotors driving respective ones of the two propellers, each of which is formed by a set of variable-pitch blades. The invention applies in particular to that type of airplane turboprop. Furthermore, various blade pitch control mechanisms are known. For example, one known system comprises a conventional actuator disposed axially in the inside space formed at the center of the annular-flowpath turbine. Mechanical connections transmit the movement of the actuator rod radially to the variable-pitch blades.

Those connection elements are complex, bulky, heavy, and expensive. Furthermore, a single actuator is required to provide the forces that need to be transmitted in order to vary the pitch of all of the blades in a given set, thereby requiring high actuator pressures for the actuator, given that the piston of such an axially-installed actuator necessarily presents an area that is small. This high control pressure is prejudicial to the actuator possessing a long lifetime.

In addition, maintenance is made complicated since the vital elements are situated inside the casing, and more particularly, in some cases, inside the turbine. They cannot be changed without dismantling the turbine.

The invention seeks to overcome those drawbacks.

OBJECTS AND SUMMARY OF THE INVENTION

The idea on which the invention is based consists in using a rotary actuator at the root of each blade, said rotary actuator being installed on a rotary support carrying the set of blades constituting a propeller.

More precisely, the invention provides a turboprop including at least one set of variable pitch rotary blades constrained to rotate with a rotary support, wherein, in order to vary its pitch, each blade of said set is coupled to a specific hydraulic rotary actuator carried by said rotary support. The rotary support is fastened to a turbine rotor. The turbine preferably has two contrarotating rotors.

Advantageously, the rotary actuator is of the dual control type, being controlled by two pressurized hydraulic fluid circuits, the pressure of the hydraulic fluid in each circuit being adjustable.

The rotary shaft of said rotary actuator can thus be secured to a swivel pin of the corresponding blade. Typically, the pin of the blade is in alignment with the shaft of the actuator.

For example, said rotary actuator comprises a cylinder having arranged therein a plurality of adjacent cavities that are distributed circumferentially around said shaft. Each cavity contains a piston secured to the shaft and subdividing said cavity into two chambers. Analogous chambers in all of the cavities are connected respectively to two pressurized hydraulic fluid circuits. Analogous chambers means chambers in the cavities which, when filled with hydraulic fluid of increasing pressure, act on the various pistons to turn the shaft in the same direction.

Advantageously, the shaft of said rotary actuator is coupled to a self-blocking locking system.

The locking system may comprise unblocking means controlled by a difference between the hydraulic fluid pressures in the two above-mentioned circuits.

For example, said locking system comprises a dual declutching device with disks interposed between two rectilinear stroke actuators, each actuator comprising a cylinder that is stationary relative to said rotary actuator and two chambers that are connected to the two above-mentioned circuits. The dual declutching device, the rectilinear stroke actuators, and the rotary actuator are advantageously arranged on a common axis. They are preferably installed in a common housing of the rotary support.

In one configuration, said dual declutching device is fitted with friction disks.

In another configuration, said dual declutching device is fitted with disks co-operating by inter-engaging shapes such as, for example, radial ribs, forming a kind of dog clutch.

BRIEF DESCRIPTION OF THE DRAWINGS

The invention can be better understood and other advantages thereof appear more clearly in the light of the following description of a turboprop in accordance with the principle of the invention, given purely by way of example and made with reference to the accompanying drawings, in which.

MORE DETAILED DESCRIPTION

Figure 1:
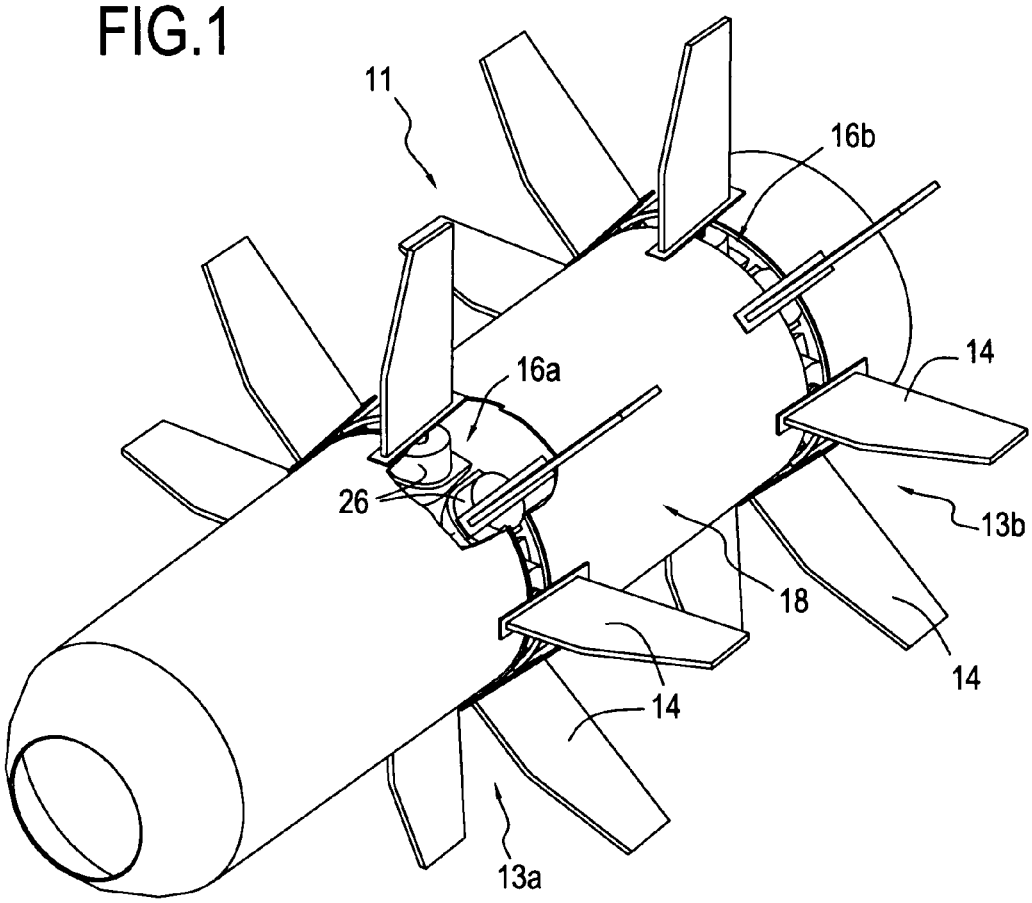
FIG. 1 is a general perspective view of a turboprop in accordance with the invention.

In the drawings, there can be seen a turboprop 11 including, in this example, two propellers 13*a*, 13*b* each constituted by a set of blades 14 of variable pitch. The blades 14 in each set are mounted on a rotary support 16*a*, 16*b*, e.g. in the form of an annular platform, itself mounted to rotate in the vicinity of the surface of a stationary casing 18. The blades 14 in each set are regularly spaced apart around the circumference and they extend generally radially from the surface of the rotary support. The stationary casing 18 houses a combustion chamber and a turbine having two contrarotating rotors. Each rotor carries and rotates one of the rotary supports 16*a*, 16*b* on which a propeller 13*a*, 13*b* having variable-pitch blades is mounted. Varying the pitch of the blades serves to control the thrust from the turboprop. The structure described above is comparable, functionally speaking, to the structure described in U.S. Pat. No. 4,758,129. Its known aspects are not described below in greater detail.

The invention relates essentially to the means for controlling the pitch of the blades 14 of at least one propeller 13*a*, 13*b*. Typically, each propeller is fitted with such variable-pitch blades.

Figure 2:
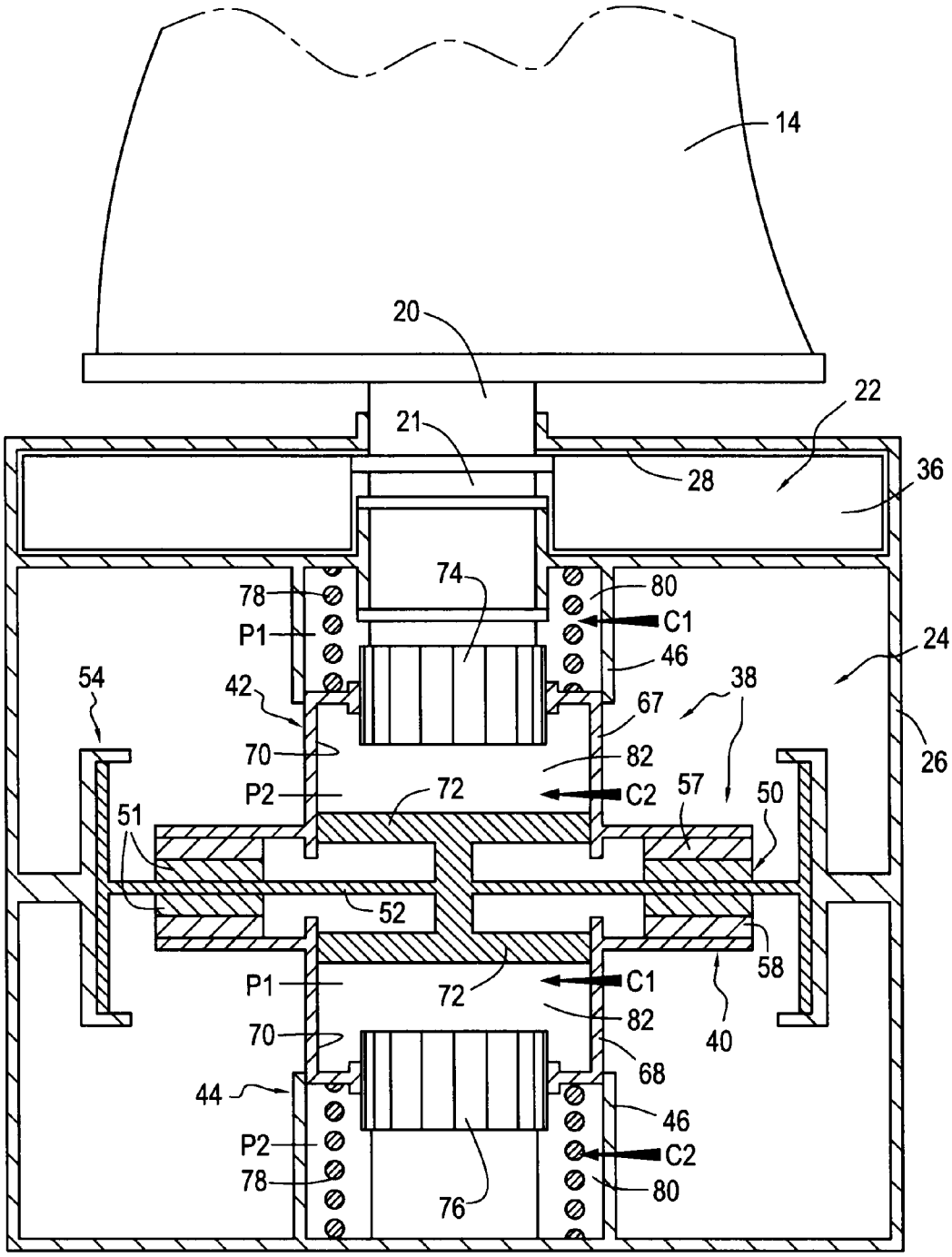
FIG. 2 is a diagram showing the principle of a device for controlling the pitch of one of the blades.

More particularly, each blade has a pitch or swivel pin 20 secured to and extending the rotary shaft 21 of an individual rotary actuator 22. As shown in FIG. 2, the rotary actuator is coupled to a self-blocking locking 24. For example, the rotary actuator 22 and the self-blocking locking system 24 are installed on the same axis in a common cylindrical housing 26, itself carried by the rotary support 16*a*, 16*b* of the corresponding propeller. In other words, each variable-pitch blade projects radially beyond one such cylindrical housing 26 carried by the rotary support.

Figure 3:
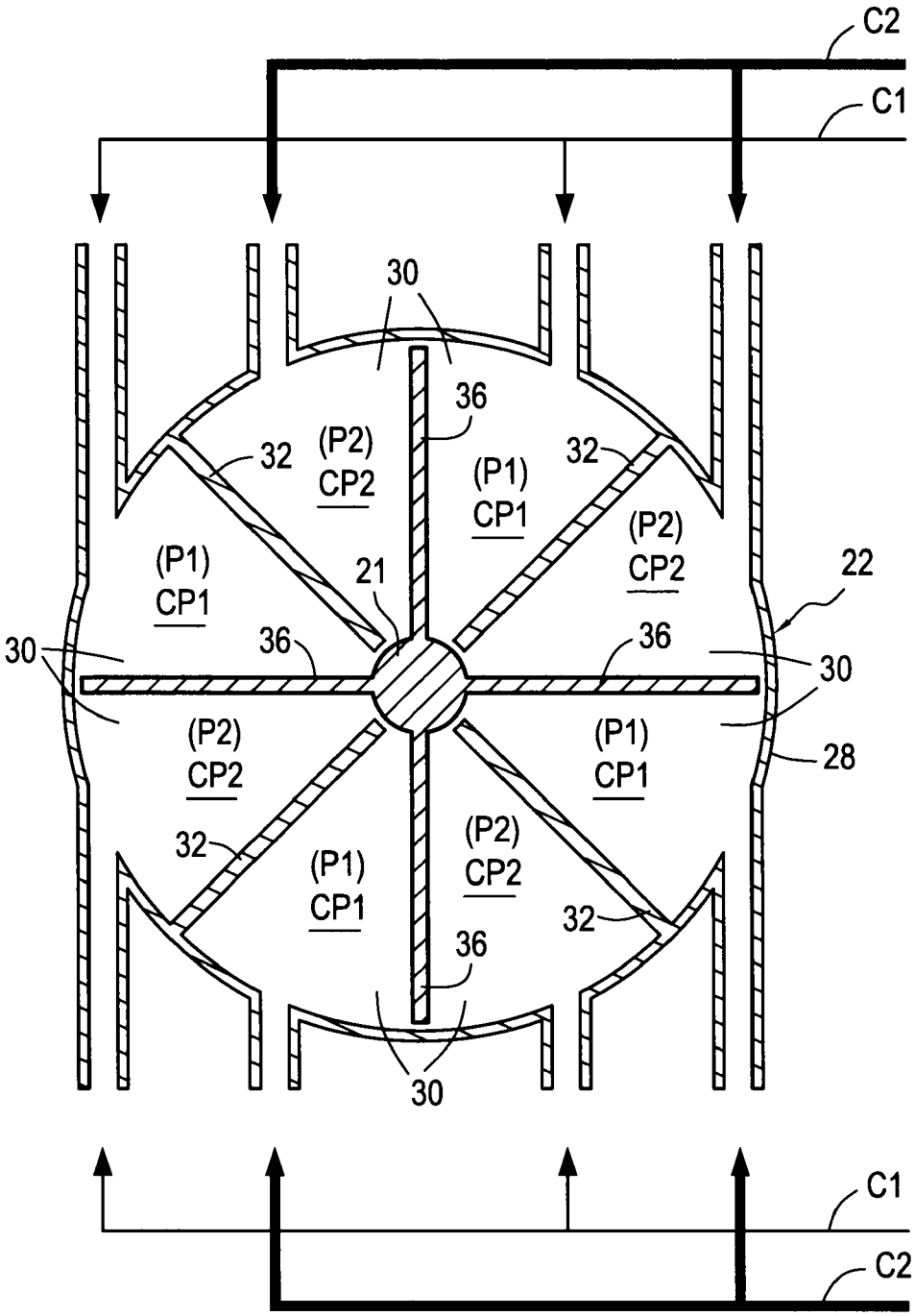
FIG. 3 is a diagrammatic view showing the principle of the rotary actuator in FIG. 2.
Figure 4:
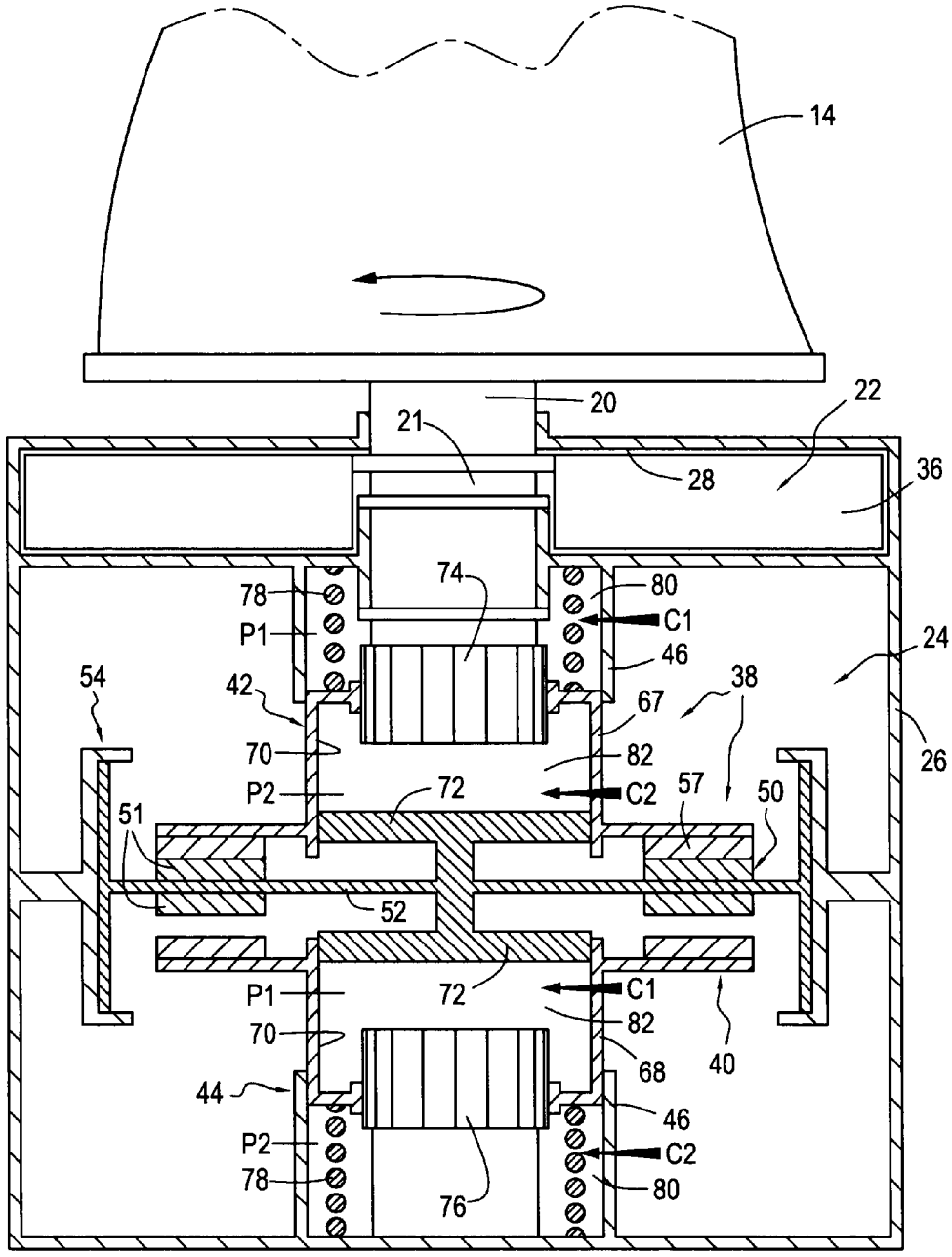
FIGS. 4 and 5 are diagrammatic views showing the principle of the device in FIG. 2 and showing how the self-blocking locking system operates when it is declutched to enable the blade to swivel respectively in one direction or in the other direction.
Figure 5:
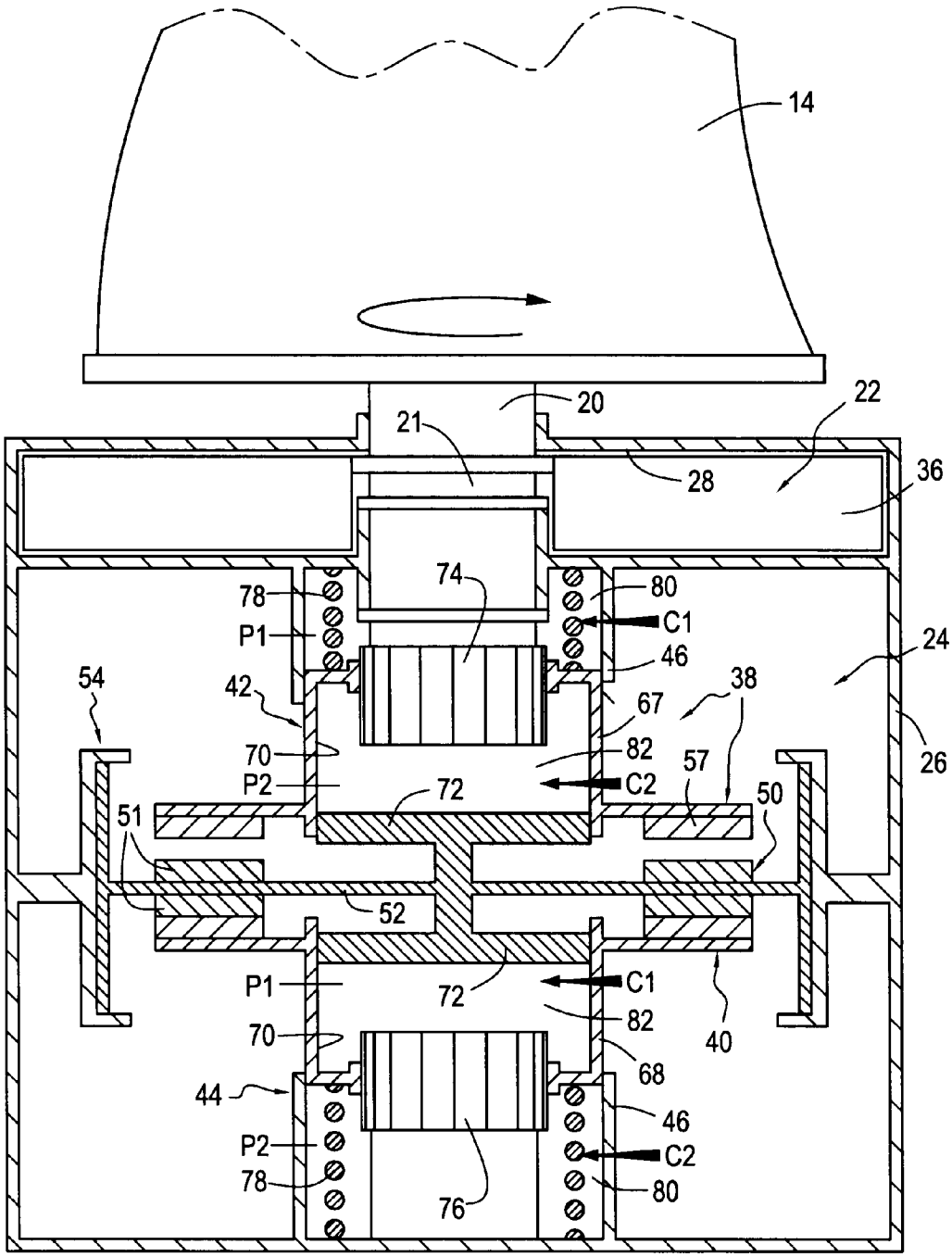

The rotary actuator 22 is of the dual control type and is driven by two pressurized hydraulic fluid circuits C1 and C2. The hydraulic fluid pressures P1 or P2 respectively in each of the circuits are adjustable in each of the circuits. It will be understood that a positive pressure difference P1−P2 will turn the actuator in one direction while a positive pressure difference P2−P1 will turn the actuator in the other direction. FIG. 3 shows the structure of the rotary actuator. It comprises, within a cylindrical body 28 forming a portion of the housing 26, a plurality of cavities 30 that are circumferentially adjacent around the central shaft. In the example, four cavities are provided, each occupying a sector of 90°. These four cavities are defined by stationary walls 32 inside the cylindrical body, with the radially-inner ends of the walls being mounted to slide in leaktight manner on the central shaft 21.

Furthermore, each cavity 30 contains a piston 36 that is secured to the shaft and that subdivides said cavity into two chambers CP1, CP2. The radially-outer end of the piston 36 slides in leaktight manner against the cylindrical wall of the enclosure 28 of the actuator. Analogous chambers CP1, CP2 in all of the cavities are respectively connected to the two pressurized hydraulic fluid circuits C1, C2.

The self-blocking locking system 24 includes unblocking means 38 controlled by the difference in pressure between the hydraulic fluid pressures in the two above-mentioned circuits C1, C2. It is installed in the remainder of the housing 26, adjacent to the cylinder 28 of the rotary actuator. The assembly forms a compact control unit installed on the rotary support at the root of the variable-pitch blade 14. The locking system comprises a dual disk declutching device 40 interposed between two rectilinear-stroke actuators 42 and 44. Each actuator 42, 44 comprises a cylinder 46 that is stationary relative to the rotary actuator, and two chambers connected to the two above-mentioned circuits C1, C2. As shown, the dual declutching system, the rectilinear stroke actuators, and the rotary actuator are arranged on a common axis which is also the swivel axis of the blade 14.

The declutching device 40 comprises a dual friction disk 50 provided with friction pads 51 on either side of a middle core 52 and associated with means 54 for holding it stationary in axial translation, and two friction disks 57, 58 that are movable in translation and that are situated on either side of the dual disk 50. The disks 57, 58 that are movable in translation are connected to pistons 67, 68 of the two rectilinear stroke actuators 42, 44, respectively. Each of these pistons includes a cavity 70 and slides inside the actuator cylinder. An end wall 72 fastened to said central dual disk is slidably mounted inside the cavity 70.

The cylinder 46 of the actuator 42 closest to the rotary actuator 22 is fastened to the wall of the housing 26 that separates the rotary actuator from the self-blocking locking system 24. The cylinder 46 of the opposite actuator 44 is fastened to the opposite wall of the housing. A fluted slideway 74 connects the transverse wall of the piston 67 to a shaft that extends the shaft 21 of the rotary actuator inwardly. A similar fluted slideway 76 connects the transverse wall of the piston of the other actuator 44 to the wall of the housing 26. Consequently, the blade can swivel with the disk 57 associated with the piston 67 of the actuator 42, while the disk 58 associated with the piston 68 of the other actuator 44 is prevented from turning.

Finally, a spring 78 is installed in the cylinder of each actuator to urge the piston 67 or 68 secured to the corresponding moving disk 57 or 58 towards the central dual disk 50.

It will be understood that each actuator 42, 44 thus has two chambers of variable volume. One chamber 80 is defined by the actuator cylinder 46 and the transverse wall of the piston, and the other chamber 82 is defined by the cavity 70 in the piston itself and the end wall 72 fastened to the central dual disk 50.

As shown in FIG. 2, the chamber 80 of the actuator 42 containing the spring 78 is connected to the hydraulic fluid circuit C1 at pressure P1, while the chamber 80 of the same actuator is connected to the hydraulic fluid circuit C2 at pressure P2. Conversely, the chamber 80 of the actuator 44 containing the spring 78 is connected to the hydraulic fluid circuit C2 at pressure P2, while the other chamber 82 is connected to the hydraulic fluid circuit C1 at pressure P1.

Thus, the springs 78 are installed in the corresponding cylinders of the two actuators to urge said corresponding piston 67 or 68 secured to the disk 57 or 58 towards the central dual disk 50. Since the disks are provided with friction pads, when the pressures P1 and P2 are equal, the springs 78 act via the pistons to hold the disks 57, 58 pressed against said central dual disk. Since the piston 68 of the actuator 44 is prevented from turning, the blade 14 cannot swivel. This is the situation shown in FIG. 2.

Operation is as follows. When the pressures P1 and P2 are equal, the self-blocking locking system is held stationary under the force of the springs 78, and no pressure difference acts within the rotary actuator 22. The pitch of the blade is thus stabilized.

If a pressure difference P1>P2 is applied, then the disk 57 remains pressed against the central dual disk 50, but the piston 68 of the other actuator 44 moves, compressing the spring, thereby separating the disk 58 from the central dual disk 50. Consequently, the piston 67, the disk 57, and the central dual disk 50 can turn together while the same pressure difference is generating rotary movement of the shaft 21 of the rotary actuator 22 (in the counterclockwise direction when looking at FIG. 3), thereby changing the pitch of the blade.

Conversely, when a pressure difference P2>P1 is applied, the chamber 80 of the actuator 42 increases in volume, thereby separating the disk 57 from said central dual disk 50. In parallel, the same pressure difference generates rotary displacement of the shaft 21 in the rotary actuator (in the clockwise direction when looking at FIG. 3). The blade consequently swivels in the opposite direction.

As mentioned above, the friction pads of the disks can be replaced by inter-engaging shapes such as radial ribs that procure the same effect of preventing the disks from turning under drive from the springs.

What is claimed is:

1. A turboprop including at least one set of variable pitch rotary blades constrained to rotate with a rotary support, wherein, in order to vary its pitch, each blade of said set is coupled to a separate hydraulic rotary actuator carried by said rotary support, wherein said rotary actuator is of the dual control type, being controlled by two pressurized hydraulic fluid circuits, the pressure of the hydraulic fluid in each circuit being adjustable, wherein a shaft of said rotary actuator is coupled to a self-blocking locking system, and wherein said locking system comprises unblocking means controlled by a difference between the hydraulic fluid pressures in the two above-mentioned circuits.

2. A turboprop according to claim 1, wherein said rotary actuator includes a rotary shaft secured to a swivel pin of said blade.

3. A turboprop according to claim 2, wherein said rotary actuator has a plurality of adjacent cavities distributed circumferentially around said shaft, and wherein each cavity contains a divider secured to said shaft and subdividing said cavity into two chambers, analogous chambers in all of the cavities being connected to respective ones of the two pressurized hydraulic fluid circuits.

4. A turboprop according to claim 1, wherein said locking system comprises a dual declutching device with disks interposed between two rectilinear stroke actuators, each actuator comprising a cylinder that is stationary relative to said rotary actuator and two chambers that are connected to the two above-mentioned circuits; the dual declutching device, the rectilinear stroke actuators, and the rotary actuator being arranged on a common axis.

5. A turboprop according to claim 4, wherein said declutching device comprises a central dual friction disk prevented from moving in translation and two disks movable in translation on either side of said central disk and connected respectively to pistons of the two rectilinear stroke actuators.

6. A turboprop according to claim 5, wherein each rectilinear stroke actuator piston includes a cavity slidable inside said cylinder and an end wall fastened to the central dual disk and slidably mounted inside said cavity.

7. A turboprop according to claim 6, wherein a spring is installed in said cylinder of each rectilinear stroke actuator to urge said piston secured to the corresponding moving disk towards said central dual disk.

8. A turboprop according to claim 4, wherein said dual declutching device is fitted with friction disks.

9. A turboprop according to claim 4, wherein said dual declutching device is fitted with disks co-operating by interengaging, radial ribs.

10. A turboprop including at least one set of variable pitch rotary blades constrained to rotate with a rotary support, wherein each blade of said set is coupled to a separate hydraulic rotary actuator carried by said rotary support, wherein said rotary actuator is controlled by pressurized hydraulic fluid circuits, the pressure of the hydraulic fluid in each circuit being adjustable, wherein a shaft of said rotary actuator is coupled to a self-blocking locking system, and wherein said locking system comprises unblocking mechanism controlled by a difference in fluid pressure in said hydraulic fluid circuits.

11. A turboprop according to claim 10, wherein said rotary actuator has a plurality of adjacent cavities distributed circumferentially.

12. A turboprop according to claim 11, wherein each cavity is subdivided into two chambers, each chamber in each cavity being respectively connected to one of the two pressurized hydraulic fluid circuits.

13. A turboprop according to claim 12, wherein each cavity is subdivided into said two chambers by a divider that slides in a leaktight manner against a wall of said rotary actuator.

* * * * *